US007523525B2

(12) United States Patent
Lawless

(10) Patent No.: US 7,523,525 B2
(45) **Date of Patent: *Apr. 28, 2009**

(54) PRY BAR ERGONOMIC HANDLE

(75) Inventor: John C. Lawless, Charlemont, MA (US)

(73) Assignee: Mayhew Steel Products, Inc. MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/429,463

(22) Filed: May 5, 2003

(65) Prior Publication Data

US 2004/0221425 A1 Nov. 11, 2004

Related U.S. Application Data

(63) Continuation-in-part of application No. 10/420,432, filed on Apr. 22, 2003, now Pat. No. 6,772,994.

(51) Int. Cl.
*E05B 1/00* (2006.01)
*B25C 11/00* (2006.01)

(52) U.S. Cl. ..... 16/430

(58) Field of Classification Search ..... 16/110.1, 16/421, 430, 436, 431; 81/177.1, 177.2, 81/177.3, 177.4, 177.5, 489–492; 254/25, 254/26

See application file for complete search history.

(56) References Cited

U.S. PATENT DOCUMENTS 2,741,248 A * 4/1956 Woodhall ..... 606/176
3,825,226 A * 7/1974 Appleman ..... 254/28
D256,442 S * 8/1980 Martin ..... D10/77
4,451,024 A 5/1984 Shepherd
4,712,304 A 12/1987 Sanelli
4,779,493 A * 10/1988 White ..... 81/438
4,977,800 A * 12/1990 Colvin ..... 81/436
5,031,881 A * 7/1991 Thurmston ..... 254/28
5,042,804 A 8/1991 Uke et al.
5,046,387 A 9/1991 Levake
5,259,277 A 11/1993 Zurbuchen
5,265,504 A * 11/1993 Fruhm ..... 81/439
5,390,572 A 2/1995 Gakhar et al.
5,475,894 A 12/1995 Wildforster
5,615,455 A 4/1997 Sorensen et al.
5,692,265 A * 12/1997 Dalury ..... 16/430
5,722,116 A 3/1998 Lin et al.
5,737,803 A * 4/1998 Tisdale ..... 16/430
5,740,586 A * 4/1998 Gomas ..... 16/436
5,781,963 A * 7/1998 Maru et al. ..... 16/430
5,816,119 A * 10/1998 Herue ..... 81/60
5,824,181 A * 10/1998 Salyer et al. ..... 156/379.8
5,836,223 A * 11/1998 Lin ..... 81/436
5,870,181 A * 2/1999 Andressen ..... 356/4.01
D414,095 S * 9/1999 Hoepfl et al. ..... D8/83

(Continued)

*Primary Examiner*—Robert J Sandy
*Assistant Examiner*—Ruth C. Rodriguez
(74) *Attorney, Agent, or Firm*—Lackenbach Siegel, Inc.

(57) ABSTRACT

A pry bar has an ergonomic handle formed with a grip portion having convex upper grip surface and a concave lower grip with an inner hard thermoplastic core and an outer elastomeric molded over cover. The convex upper grip surface portion is more distantly disposed from the handle longitudinal axis than the curved lower grip surface portion. The upper grip surface is formed with a distally disposed outwardly flared guard formed with thumb receiving recess. The handle sides are formed with elongated outwardly bulged contoured respective palm engaging portions for right or left handed grip engagement.

7 Claims, 3 Drawing Sheets

U.S. PATENT DOCUMENTS

| | | | | |
|---|---|---|---|---|
| 5,956,799 | A | 9/1999 | Panaccione et al. | |
| 5,964,009 | A | 10/1999 | Hoepfl et al. | |
| 6,079,298 | A * | 6/2000 | Gasperi et al. | 81/63.1 |
| 6,148,483 | A * | 11/2000 | DeGraff | 16/430 |
| 6,295,903 | B1 * | 10/2001 | Tipper et al. | 81/489 |
| 6,295,904 | B1 * | 10/2001 | Webb | 81/492 |
| 6,345,556 | B1 | 2/2002 | Lin | |
| 6,378,402 | B1 | 4/2002 | Kalomeris et al. | |
| 6,421,860 | B1 | 7/2002 | Abbott | |
| 6,471,186 | B1 | 10/2002 | Lawless | |
| RE38,093 | E | 4/2003 | Chiou | |
| 6,640,672 | B1 * | 11/2003 | Cheng | 81/177.5 |
| 6,655,243 | B2 * | 12/2003 | Anderson et al. | 81/490 |
| 6,663,082 | B1 * | 12/2003 | Ploeger | 254/21 |
| 6,772,994 | B1 * | 8/2004 | Lawless | 254/25 |
| 2002/0078531 | A1 * | 6/2002 | Chen | 16/421 |
| 2002/0088126 | A1 * | 7/2002 | Farland | 30/344 |
| 2002/0134971 | A1 | 9/2002 | Christensen | |
| 2002/0170394 | A1 * | 11/2002 | Tsai | 81/439 |
| 2003/0200843 | A1 * | 10/2003 | Lin | 81/438 |

* cited by examiner

PRY BAR ERGONOMIC HANDLE

RELATED PRIOR APPLICATIONS

This application is a continuation-in-part application of Ser. No. 10/420,432, filed Apr. 22, 2003, now U.S. Pat. No. 6,772,994.

BACKGROUND OF THE INVENTION

This invention relates to pry bars and pry bar handles. Specifically, this invention relates to a pry bar ergonomic handle.

BACKGROUND AND DISCUSSION OF THE PRIOR ART

In general, pry bars were of all metal construction and were cumbersome to grip and use. Often the user has to grip a rectilinear metal portion of the pry bar in use. One such prior art construction is disclosed in U.S. Pat. No. 6,058,809 to Flanz.

A wrecking tool is disclosed in U.S. Patent application Publication No. 2002/0134971 to Christensen. The Christensen tool has an elongate octagonal cross-sectional metal handle or bar stock portion. A non-octagonal handgrip is attached to the octagonal metal bar.

It was generally known to provide a soft elastomeric molded over cover on a molded hard thermoplastic core for improved grip for knives, screwdrivers, and like bladed tools. Such prior art constructions are disclosed in Sanelli, U.S. Pat. No. 4,712,304; Gakhar, U.S. Pat. No. 5,390,572; Hoepfl, U.S. Pat. No. 5,964,009; and Panaccione, U.S. Pat. No. 5,956,799.

The pry bar art desires an improved handle so as to provide improved grip with ergonomic functionality.

It is therefore a principal object of the present invention to provide an ergonomic handle pry bar.

It is another object of the present invention to provide an improved grip pry bar handle.

The aforesaid inventive aspects alone and in combination provide an ergonomic handle pry bar construction.

It is still another object the present invention to provide a pry bar with diverse functionality.

It is still a further object of the present invention to provide a pry bar as aforesaid which is practical in design, manufacture and use.

Present applicant is the inventor of the ergonomic pry bar handle disclosed in U.S. Pat. No. 6,471,186, granted Oct. 29, 2002, which patent and the present application are commonly assigned to Mayhew Steel Products, Inc.

SUMMARY OF THE INVENTION

A pry bar ergonomic handle has a longitudinal axis and a grip portion having an upper convex surface and a lower concave surface with a recess formed in the distal end of the upper surface to receive the thumb, and the grip portion further includes oppositely disposed bulged sides. The user's grip hand engages the upper and lower surfaces with the palm engaging one of the bulged sides for ergonomic effect in heavy duty pry bar use. The thumb recess is formed in a outwardly flared distal end portion of the handle. The handle has a hard thermoplastic core and an integrally molded over elastomeric material cover. The elastomeric material covers a substantial portion but not the entire grip portion. A metal impact cap is fixedly secured in the proximate end of the handle.

DESCRIPTION OF THE PREFERRED EMBODIMENTS

Figure 1:
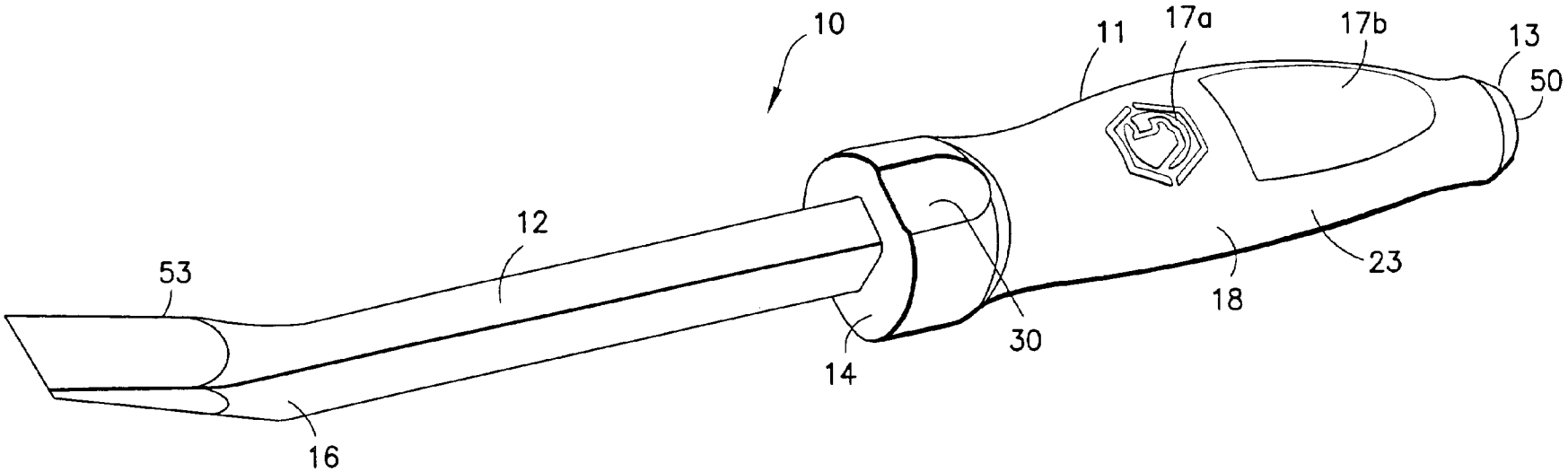
FIG. 1 is a perspective view of the pry bar embodiment of the present invention.

Referring to FIGS. 1-8, there is shown pry bar 10 of the present invention. Pry bar 10, in general terms, includes handle 11 and a fixedly attached metal shank or blade 12. Handle 11 has a proximate end 13 and a distal end 14. Shank 12 has a proximate end 15 and a distal end 16. Handle 11 is formed of a hard thermoplastic molded core 17 and a molded over integrally bonded elastomeric cover 18, wherein cover 18 is formed of relatively soft elastomeric material.

The proximate end 25 of blade 12 is securely fixedly molded in core 17, with the formation of core 17, by means known in the art. The elastomeric cover 18 is then molded over or around the core by means well known in the knife, screwdriver, and like bladed hand tool handle prior art.

Figure 6:
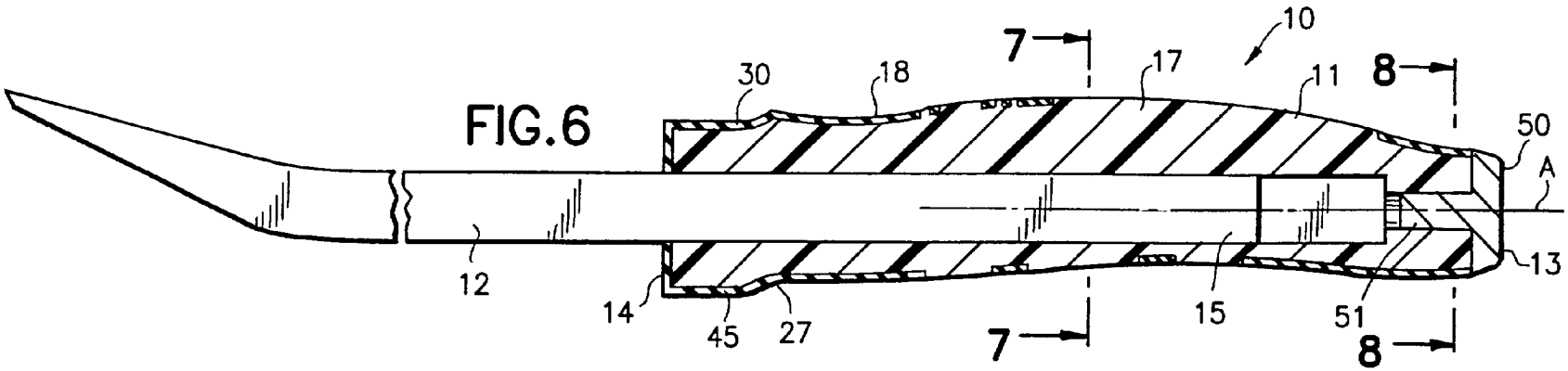
FIG. 6 is a sectional view taken along line 6-6 of FIG. 5.

Handle 11 grip portion has an upper grip surface 20 and oppositely disposed lower grip surface 21, and oppositely disposed bulged sides 22 and 23. Handle 11 has an elongated central axis A, as best shown in FIGS. 3 and 6. Upper grip portion 20 is further disposed from axis A than lower grip portion 32. Each handle side 22 and 23 has an outwardly or protruding rounded contour. The sides 22 and 23 are tapered inwardly in the proximate direction as at 37 and 38 respectively, as best shown in FIGS. 2 and 4.

Figure 8:
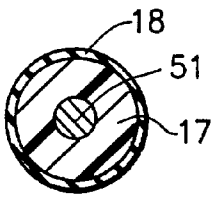
FIG. 8 is a sectional view taken along line 8-8 of FIG. 6.

A metal impact cap 50 is fixedly disposed in the core central through hole or bore at the proximate end 13 of the handle 11. Cap 50 has a prong 51 which is fixedly secured within the handle core 17 as best shown in FIGS. 6 and 8. Cap 50 is used by way of example, to high impact drive elements, such as screw heads prior to driving same.

Figure 2:
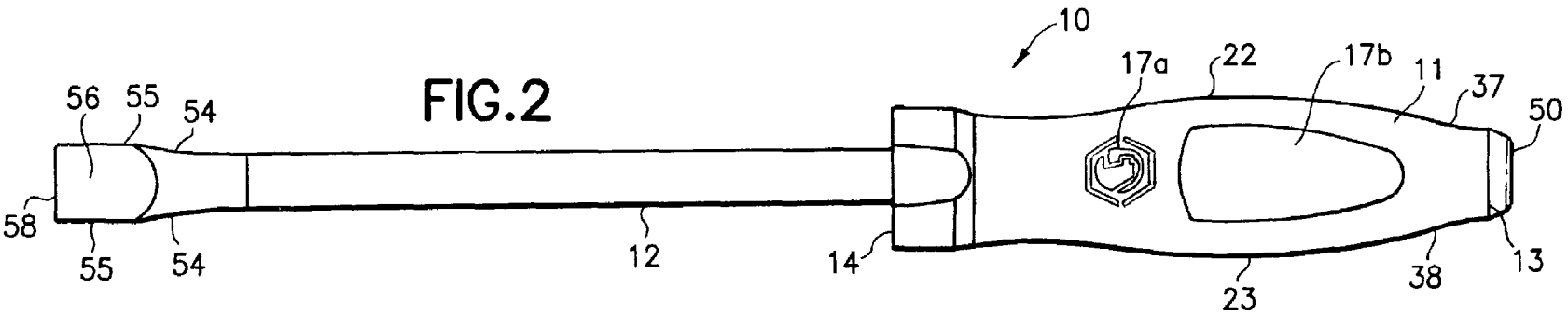
FIG. 2 is atop plan view of the pry bar of FIG. 1.
Figure 3:
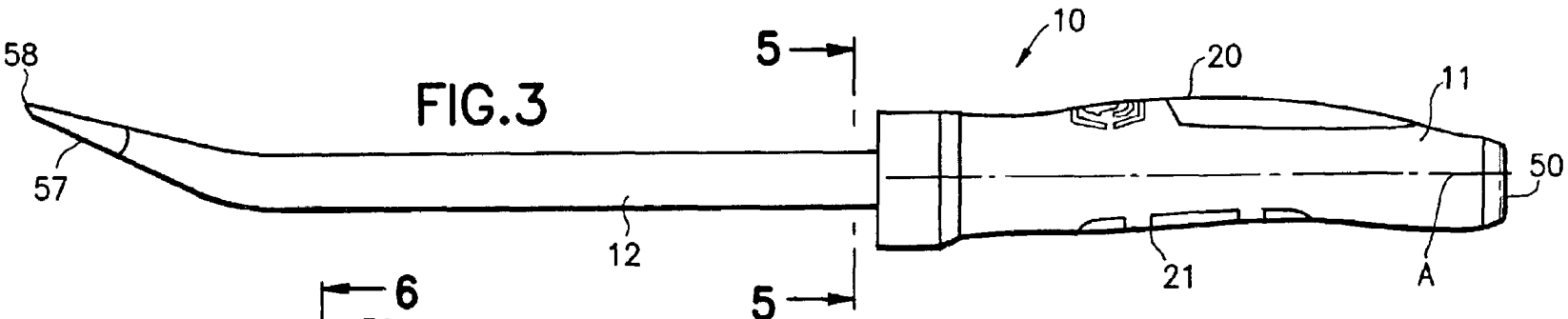
FIG. 3 is a side elevational view of the pry bar of FIG. 1.
Figure 4:
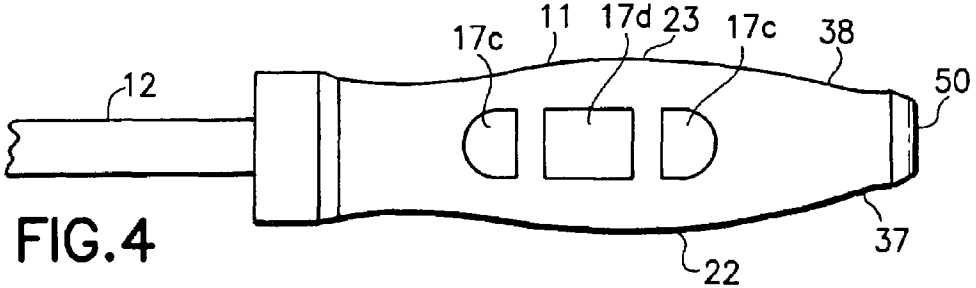
FIG. 4 is a bottom partial fragmentary view of the pry bar as shown in FIG. 3.
Figure 5:
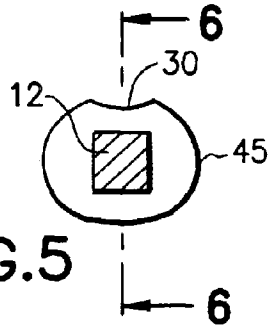
FIG. 5 is a sectional view taken along line 5-5 of FIG. 3.

With specific reference to FIGS. 2, 3 and 6, blade 12 is of square or rectilinear cross-sectional metal construction. Blade 12 has a proximate end 15 and a distal end 16. Proximate end 15 is molded in situ with core 17, so as to be fixedly secured within handle 11, by means well known in the art. Blade distal end 16 is formed with a pry end 53. Pry end 53 has outwardly tapered sides 54, and parallel sides 55, and upper and lower surfaces 56 and 57. Surfaces 56 and 57 are distally tapered, and extend towards sharpened edge or tip 58. Tip 58 is upwardly angularly disposed with respect to blade 12. Blade 12 pry end is angularly disposed in respect to handle 12.

Blade 12 proximate end 15 is disposed in the central through hole or bore in core 17 and the distal end of 51 of metal impact cap 50 is also disposed in the central through hole or bore in core 17 so that the metal impact cap distal end and the blade proximate end are in facing disposition, as best shown in FIGS. 5-8.

In the aforesaid manner of construction, there is provided an ergonomic pry bar and handle. More specifically, the user's palm is partially disposed on the upper grip surface and one of the outwardly bulged or contoured sides (depending upon whether the user is right or left handed), with the fingers generally engaging the oppositely disposed bulged side. The thumb is disposed in recess 30 of distal guard 45. The forefinger is received in recess 27 and retained therein by distal guard 45. Recesses 30 and 27 are covered by elastomeric material cover 18. In the aforesaid manner of construction, the user grips the handle and uses the pry bar with comfort and reduced fatigue as compared with conventional construction pry bars.

Figure 7:
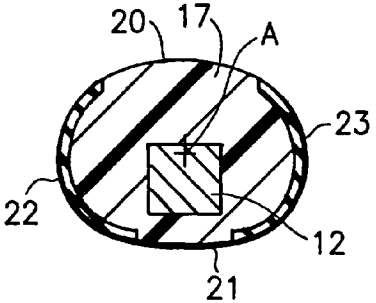
FIG. 7 is a sectional view taken along line 7-7 of FIG. 6.

Referring specifically to FIGS. 3, 6 and 7, the grip portion of the handle has a cross-section having an upper convex surface 20 and a lower surface 21 disposed directly below the convex surface and oppositely disposed convex sides 22 and 23. The rectilinear pry bar blade 12 is disposed more adjacent the grip portion lower surface 21 than the convex upper surface 20, so that the pry bar is asymmetrically disposed with respect to the handle end surfaces. The pry bar edge 58 is disposed more adjacent the grip portion upper surface 20 than the grip portion lower surface 21. In the aforesaid manner of construction, the user grips the ergonomic handle grip portion and provides a leverage force to the pry edge.

The elastomeric cover 18 covers substantially all of core 17, but does not cover the entire core 17. Upper surface areas 17*a* and 17*b* and lower surface areas 17*c*, 17*d* and 17*e* are uncovered. Areas 17*a*-17*c* are available for permanently imprinting the manufacturers name and for ornamental aesthetic purposes.

The core may be formed of hard thermoplastic using and the cover may be formed of with elastomeric material well known in the hand tool handle art.

The afore-discussed handle surfaces and contours, and in conjunction with the pry bar configuration and disposition with respect to the handle, provides an ergonomic pry bar.

While the foregoing describes certain embodiments of the invention, various modifications and changes may be made within the spirit and scope of the invention, as defined by the adjoined claims.

What is claimed is:

1. An ergonomic pry bar handle construction comprising:

a handle comprising a unitary molded thermoplastic material construction, said handle comprises a distal end face and a proximate end face and a grip portion disposed between the end faces and disposed more adjacent the proximate end face than the distal end face, said handle comprises a center line, and a through bore extending along the center line from the distal end face to the proximate end face, said through bore comprises a rectilinear portion, said rectilinear portion extends from the distal end face along the center line through the handle grip portion, said rectilinear portion being sized to fixedly, contactingly hold a rectilinear pry bar blade, further comprising, a rectilinear pry bar blade contactingly fixedly disposed in the rectilinear portion and extending through the grip portion, said pry bar blade having a distal end comprising a pry edge angularly disposed with respect to the centerline, and a metal impact cap fixedly contactingly disposed in the through bore at the proximate end face, said impact cap extends distally and is adjacent the rectilinear pry bar without an insert disposed between the metal impact cap and pry bar blade;

said grip portion comprising a cross-section having an upper convex surface and a lower surface disposed directly below the convex surface and oppositely disposed convex sides, said rectilinear pry bar blade being disposed more adjacent lower surface than the convex upper surface, wherein said pry bar is asymmetrically disposed with respect to the grip portion upper and lower surfaces, and symmetrically disposed with respect to the end faces, said pry edge is disposed more adjacent the grip portion upper surface than the grip portion lower surface, whereby the user, grips the ergonomic handle grip portion and provides a leverage force to the pry edge.

2. The ergonomic pry bar handle construction of claim 1, further comprising an elastomeric over-molded material portion partially covering the thermoplastic material in the grip portion, said elastomeric material extends distally to the distal end face, whereby there is improved grip for pry bar use.

3. The ergonomic pry bar handle construction of claim 1, said through bore comprises a circular portion said circular portion having a smaller cross dimension than said rectilinear portion, said rectilinear portion and said circular portion being contiguous so as to form an edge, said pry bar being disposed distally from said edge and said metal impact cap being proximately disposed from said edge.

4. The ergonomic handle construction of claim 1, said upper surface being substantially free of said elastomeric material in the upper grip portion upper surface disposed directly above the lower surface.

5. The ergonomic pry bar handle construction of claim 1, said construction consists of components, the handle, the pry bar handle and the impact cap.

6. The ergonomic pry bar handle construction of claim 1, said lower surface disposed directly below the convex upper surface comprises a concave surface extending towards the proximate end.

7. The ergonomic pry bar handle of claim 1, said grip portion convex upper surface comprising convexities in both the cross-section direction and in the center line direction.

* * * * *